US009370957B2

(12) United States Patent
Nagoshi

(10) Patent No.: US 9,370,957 B2
(45) Date of Patent: Jun. 21, 2016

(54) COATED PAPER FOR PRINTING BY INDUSTRIAL INK JET PRINTING MACHINE

(71) Applicant: MITSUBISHI PAPER MILLS LIMITED, Tokyo (JP)

(72) Inventor: Masanori Nagoshi, Tokyo (JP)

(73) Assignee: MITSUBISHI PAPER MILLS LIMITED, Tokyo (JP)

( * ) Notice: Subject to any disclaimer, the term of this patent is extended or adjusted under 35 U.S.C. 154(b) by 0 days.

(21) Appl. No.: 14/421,422

(22) PCT Filed: Aug. 9, 2013

(86) PCT No.: PCT/JP2013/071613
§ 371 (c)(1),
(2) Date: Feb. 12, 2015

(87) PCT Pub. No.: WO2014/027614
PCT Pub. Date: Feb. 20, 2014

(65) Prior Publication Data

US 2015/0298478 A1 Oct. 22, 2015

(30) Foreign Application Priority Data

Aug. 13, 2012 (JP) ..... 2012-179453
Jun. 11, 2013 (JP) ..... 2013-122708

(51) Int. Cl.

| | |
|---|---|
| ***B41M 5/00*** | (2006.01) |
| ***B41M 5/50*** | (2006.01) |
| ***B41M 5/52*** | (2006.01) |
| *B41L 5/00* | (2006.01) |
| *B41J 2/01* | (2006.01) |

(52) U.S. Cl.
CPC ..... *B41M 5/502* (2013.01); *B41M 5/506* (2013.01); *B41M 5/5218* (2013.01); *B41M 5/5236* (2013.01); *B41M 5/5245* (2013.01); *B41M 5/5254* (2013.01); *B41J 2/01* (2013.01); *B41L 5/00* (2013.01); *B41M 2205/42* (2013.01)

(58) Field of Classification Search
CPC .... B41M 5/502; B41M 5/506; B41M 5/5218; B41M 5/5245; B41J 2/01; B41L 5/00
See application file for complete search history.

(56) References Cited

U.S. PATENT DOCUMENTS

| | | | | |
|---|---|---|---|---|
| 7,955,667 | B2 | 6/2011 | McManus et al. | |
| 8,609,210 | B2 | 12/2013 | Nagoshi et al. | |
| 2008/0038491 | A1* | 2/2008 | Ikeda | B41M 5/506 428/32.25 |
| 2010/0028659 | A1* | 2/2010 | Shimono | C01F 11/181 428/330 |
| 2011/0012956 | A1* | 1/2011 | Kagata | B41J 2/16532 347/29 |
| 2012/0114880 | A1* | 5/2012 | Nagoshi | B41M 5/502 428/32.33 |

FOREIGN PATENT DOCUMENTS

| | | | | |
|---|---|---|---|---|
| JP | 9-104165 | A | 4/1997 | |
| JP | 2000-43408 | A | 2/2000 | |
| JP | 2001-347750 | A * | 12/2001 | B41M 5/00 |
| JP | 2002-292996 | A | 10/2002 | |
| JP | 2003-170653 | A | 6/2003 | |
| JP | 2008-162239 | A | 7/2008 | |
| JP | 2009-532248 | A | 9/2009 | |
| JP | 2011-132649 | A | 7/2011 | |
| WO | WO 2011/007775 | A1 * | 1/2011 | B41M 5/00 |
| WO | WO 2011/007775 | A1 | 1/2011 | |

* cited by examiner

*Primary Examiner* — Betelhem Shewareged
(74) *Attorney, Agent, or Firm* — Birch, Stewart, Kolasch & Birch, LLP

(57) ABSTRACT

A coated paper having a base paper and at least two coating layers, a first coating layer and a second coating layer, provided on at least one surface of the base paper. The first coating layer is provided on the base paper and contains an organic pigment, a cationic compound, a binder, and a dog-tooth-shaped precipitated calcium carbonate having a minor axis of 0.1-0.5 μm and a major axis of 0.5-2.5 μm. The second coating layer is provided on the first coating layer and contains at least an inorganic ultrafine particle that is selected from hydrated alumina, gas phase process silica, pulverized wet-process silica, and colloidal silica, and that has a mean particle size of 330 nm or less. The paper has a surface pH of from 5.0 to 7.5, and the coated surface coated with the second coating layer has a 75-degree gloss value of 45% or more.

10 Claims, No Drawings

COATED PAPER FOR PRINTING BY INDUSTRIAL INK JET PRINTING MACHINE

TECHNICAL FIELD

The present invention relates to coated paper for printing, and, in particular, to coated paper for printing by industrial inkjet printing machines used in the field of commercial printing.

BACKGROUND ART

In recent years, inkjet recording that uses water-soluble inks has been significantly developed and increasingly widely used. Inkjet recording creates color images by jetting fine droplets of inks based on various operation principles to allow them to impact on recording sheets such as paper. Inkjet recording is fast and quiet, facilitates multicolor printing, is versatile in terms of recordable patterns, and is free from the need of development or fixation. Thus, inkjet recording is employed by printing machines for various applications. Inkjet recording also creates images that are comparable to prints produced by offset printing or by a color photographic technique. Additionally, a small number of copies can be printed by inkjet recording more inexpensively than by offset printing or a color photographic technique. For these reasons, inkjet printing is widely employed in the commercial printing field.

Industrial inkjet printing machines for commercial printing, in particular, industrial inkjet printing machines of a web press system, are used in on-demand printing applications such as printing of addresses, customer information, numbers, and bar codes. In such an on-demand printing, fixed information is often printed by offset printing and then variable information is printed by inkjet printing.

Industrial inkjet printing machines of a web press system that have a printing speed of 60 m/min or higher, and a still higher speed exceeding 120 m/min have recently been developed. Hence, there is a growing need for coated printing paper having ink absorption properties suitable for printing at such high speeds using an industrial inkjet printing machine.

Additionally, to meet the demand for high-definition and high-quality commercial printing, there is also a need for coated printing paper that is usable in industrial inkjet printing machines and that has similar textures to those of coated printing paper such as general-purpose matte coated woodfree (CWF) paper and gloss coated woodfree (CWF) paper.

The inks used in industrial inkjet printing machines include water-based dye inks and water-based pigment inks. These inks require different properties of coated printing paper.

The water-based dye inks need coated printing paper that achieves improved color densities and water resistance of printed images on the paper. More specifically, the water-based dye inks need coated printing paper that enables high color densities and vivid color tone, and that prevents the inks from bleeding when the paper is left, after printing, under humid conditions or when printed sections are exposed to water for some reason.

The water-based pigment inks need coated printing paper that enables improved scratch or abrasion resistance of printed images on the paper. More specifically, the water-based pigment inks need coated printing paper that prevents the inks from coming off from printed sections when rubbed with something, after being printed and dried, so that printed matter is free from smears.

The water-based pigment inks also need coated printing paper that can prevent or reduce uneven printing. Uneven printing is a phenomenon in which printing paper exhibits non-uniform saturation of inks that are fixed in the final printed image, after the inks are dried, due to non-uniform ink absorption by the printing paper during high speed printing. Because inks for industrial inkjet printing machines have a lower amount of colorants, uneven printing is conspicuous in the printed image compared with offset printing. Thus, the water-based pigment inks need coated printing paper that eliminates or reduces uneven printing when printed at a high speed.

The coated printing paper is required to be printable at a high speed with desirable absorption properties, regardless of whether the inks are water-based dye inks or water-based pigment inks.

High gloss coated paper that is composed of two or more coating layers and usable in offset printing and inkjet printing has been described. Specifically, an inkjet recording paper having two coating layers, a lower coating layer that contains kaolin, precipitated calcium carbonate, and an aqueous adhesive, and an upper coating layer that contains silica sol and/or hydrated alumina, a dye fixer, and an alkali metal salt and/or an alkaline-earth metal salt is known (see, for example, Patent Document 1). Another known example is an inkjet recording paper having two coating layers, a lower coating layer that contains kaolin, precipitated calcium carbonate, and an aqueous adhesive, and an upper coating layer that contains a pigment that has a mean particle size of 0.01-1 μm and is selected from silica, alumina, and hydrated alumina, and a water-soluble resin binder (see, for example, Patent Document 2). Still another known example is an inkjet recording paper having two coating layers, an undercoating layer that contains an alkaline-earth metal salt and an organic pigment, and a top coating layer that contains an inorganic fine particle with a primary particle size of 100 nm or less and a secondary particle size of 400 nm or less, in which the coating color for the top coating layer has a pH of 5.0 or less (see, for example, Patent Document 3). Yet another known example is a pigment coated paper for printing having at least two layers including a pigment coating inner layer that contains precipitated calcium carbonate and a styrene-butadiene copolymer latex, and an outermost pigment coating layer including a coating layer that contains precipitated calcium carbonate with a mean particle size (minor axis) of 0.8 μm or less and a styrene-butadiene copolymer latex, on which a water-soluble multivalent metal salt is applied (see, for example, Patent Document 4).

RELATED ART DOCUMENT

Patent Documents

Patent Document 1: Japanese Patent Application Kokai Publication No. H09-104165 (1997)

Patent Document 2: Japanese Patent Application Kokai Publication No. 2008-162239

Patent Document 3: Japanese Patent Application Kokai Publication No. 2003-170653

Patent Document 4: Japanese Patent Application Kokai Publication No. 2011-132649

DISCLOSURE OF THE INVENTION

Problem to be Solved by the Invention

None of the printing papers described in Patent Documents 1-4 are necessarily satisfactory in all the requirements and properties including offset printability, ink absorption properties for industrial inkjet printing machines with increasingly higher printing speeds, color densities and water resistance of printed images when printed by an industrial inkjet printing machine that uses water-based dye inks, and elimination or reduction of uneven printing when printed by an industrial inkjet printing machine that uses water-based pigment inks. Hence, there is a need for a coated paper for printing by industrial inkjet printing machines that can more satisfactorily meet the requirements and properties for such printing.

Thus, present invention provides a coated paper for printing by industrial inkjet printing machines that has the following properties.

1. Superior offset printability.
2. Superior ink absorption properties in printing by an industrial inkjet printing machine.
3. Superior color densities and water resistance of printed images when printed by an industrial inkjet printing machine that uses water-based dye inks.
4. Superior elimination or reduction of uneven printing when printed by an industrial inkjet printing machine that uses water-based pigment inks.

Means for Solving the Problem

In view of the above, the present inventor has achieved the following invention as a result of intensive study.

A first aspect of the present invention is a coated paper for printing by an industrial inkjet printing machine, the coated paper including:

a base paper; and at least two coating layers, a first coating layer and a second coating layer, provided on at least one surface of the base paper, wherein the first coating layer is provided on the base paper and contains an organic pigment, a cationic compound, a binder, and a dogtooth-shaped precipitated calcium carbonate that has a minor axis of from 0.1 μm to 0.5 μm and a major axis of from 0.5 μm to 2.5 μm, the second coating layer is provided on the first coating layer and contains at least an inorganic ultrafine particle that is selected from hydrated alumina, gas phase process silica, pulverized wet-process silica, and colloidal silica, and that has a mean particle size of 330 nm or less, the coated paper has a surface pH of from 5.0 to 7.5, wherein the surface pH is determined in accordance with Japan Technical Association of the Pulp and Paper Industry (JAPAN TAPPI) No. 49-2: 2000 by dropping an indicator solution for determining a pH on a surface of the second coating layer, spreading the solution into a thin layer over the surface to color the solution, and comparing the hue that the indicator solution shows with the hues in the pH standard color change table, and the second coating layer has a 75-degree gloss value as defined by JIS Z8741 of 45% or more.

Thus, a coated paper for printing by an industrial inkjet printing machine that has desirable offset printability, and that is well suited for printing by an industrial inkjet printing machine using water-based pigment inks or water-based dye inks (specifically, superior in ink absorption properties for both water-based dye inks and water-based pigment inks, superior in color densities and water resistance of printed images when printed by an industrial inkjet printing machine with water-based dye inks, and superior in eliminating or reducing uneven printing when printed by an industrial inkjet printing machine with water-based pigment inks) is obtained.

Furthermore, a second aspect of the present invention is a coated paper for printing by an industrial inkjet printing machine, the coated paper including:

a base paper; and at least two coating layers, a first coating layer and a second coating layer, provided on at least one surface of the base paper, wherein the first coating layer is provided on the base paper and contains an organic pigment, a cationic compound, a binder, and a dogtooth-shaped precipitated calcium carbonate that has a minor axis of from 0.1 μm to 0.5 μm and a major axis of from 0.5 μm to 2.5 μm, the second coating layer is provided on the first coating layer and contains at least an inorganic ultrafine particle that is selected from hydrated alumina, gas phase process silica, pulverized wet-process silica, and colloidal silica, and that has a mean particle size of 330 nm or less, the second coating layer is formed by applying a coating composition on the first coating layer and drying the composition, the composition for forming the second coating layer having a pH exceeding 5.0 and 6.5 or less, and the surface of the top coating layer has a 75-degree gloss value as defined by JIS Z8741 of 45% or more.

Thus, a coated paper, for printing by an industrial inkjet printing machine, that also has desirable offset printability, and that is well suited for industrial inkjet printing machines using water-based pigment inks or water-based dye inks (specifically, superior in ink absorption properties for both water-based dye inks and water-based pigment inks, superior in color densities and water resistance of printed images when printed by an industrial inkjet printing machine with water-based dye inks, and superior in eliminating or reducing unevenness when printed by an industrial inkjet printing machine with water-based pigment inks) is obtained.

Yet another aspect of the present invention is a coated paper for printing by an industrial inkjet printing machine, the coated paper including:

a base paper; and at least two coating layers, a first coating layer and a second coating layer, provided on at least one surface of the base paper, wherein the first coating layer is provided on the base paper and contains an organic pigment, a cationic compound, a binder, and a dogtooth-shaped precipitated calcium carbonate that has a minor axis of from 0.1 μm to 0.5 μm and a major axis of from 0.5 μm to 2.5 μm, the second coating layer is provided on the first coating layer and contains at least an inorganic fine particle that is selected from hydrated alumina, gas phase process silica, pulverized wet-process silica, and colloidal silica, and that has a mean particle size of 330 nm or less, the second coating layer is formed by applying a coating composition on the first coating layer and drying the composition, the composition for forming the second coating layer having a pH exceeding 5.0 and 6.5 or less, the paper has a surface pH of from 5.0 to 7.5, wherein the surface pH is determined by dropping an indicator solution for determining a pH on a surface of the second coating layer in accordance with Japan Technical Association of the Pulp and Paper Industry (JAPAN TAPPI) No. 49-2: 2000, spreading the solution into a thin layer over the surface so as to color the surface, and comparing the hue that the indicator solution shows with the hues in the pH standard color change table, and the surface of the top coating layer has a 75-degree gloss value as defined by JIS Z8741 of 45% or more.

In the present invention, the organic pigment is preferably a hollow spherical organic pigment.

This enables the coated paper for printing by an industrial inkjet printing machine to have further desirable gloss and ink absorption properties when printed by an industrial inkjet printing machine.

Still another aspect of the present invention is a printing method using an industrial inkjet printing machine, which includes the steps of feeding the above-described coated paper for printing by an industrial inkjet printing machine, and forming a printed image on the coated printing paper by the printing machine that uses water-based dye inks or water-based pigment inks at a printing speed of 60 m/min or more.

This combination creates printed images superior in color densities and water resistance with less uneven printing.

Further aspect of the present invention is a method for forming a printed image, which method includes the steps of feeding the coated printing paper, and forming a printed image on the coated printing paper by an offset printing machine and/or an industrial inkjet printing machine.

Thus, a desirable printed image can be formed by using an offset printing machine and/or an industrial inkjet printing machine.

MODE FOR CARRYING OUT THE INVENTION

The coated paper for printing by an industrial inkjet printing machine according to the present invention (hereinafter simply referred to as "coated printing paper") will be described in detail below.

As used herein, the term "industrial inkjet printing machine" refers to an industrial inkjet printing machine for use in commercial printing. Examples of such printing machines include inkjet printing machines that have a printing speed of 15 m/min or more, a higher speed of 60 m/min or more, or a still higher speed exceeding 120 m/min, and industrial inkjet printing machines of a web press system loaded with pigment inks or dye inks. Industrial inkjet printing machines are described, for example, in Japanese Patent Application Kokai Publication No. 2011-251231 or No. 2005-88525. Such industrial inkjet printing machines are sold under the trade names of, for example, TruepressJet by Dainippon Screen Mfg. Co. Ltd., MJP series by Miyakoshi Printing Machinery Co. Ltd., Prosper and VERSAMARK by Kodak Company, and JetPress by Fujifilm Corporation. As used herein, "industrial inkjet printing machine" is distinguished from inkjet printers with a printing speed of several meters/min including compact home printers and large-format printers used by printing companies (hereinafter referred to as "inkjet printer"). As used herein, "inkjet printing" refers to printing by using an industrial inkjet printing machine.

Offset printing is an indirect printing technique in which inks are transferred first to a blanket and then to an object to be printed. Good offset printability means that no problems such as blanket piling are found after offset printing.

In the present invention, the coated printing paper includes a base paper. The base paper used in the present invention is paper made by conventional method for making acid, neutralized, or alkaline papers from paper stuff including cellulose pulp selected from chemical pulp such as LBKP (Leaf Bleached Kraft Pulp) and NBKP (Needle Bleached Kraft Pulp); mechanical pulp such as GP (Groundwood Pulp), PGW (Pressure GroundWood pulp), RMP (Refiner Mechanical Pulp), TMP (ThermoMechanical Pulp), CTMP (ChemiThermoMechanical Pulp), CMP (ChemiMechanical Pulp), and CGP (ChemiGroundwood Pulp); and waste paper pulp such as DIP (DeInked Pulp) (these may be used alone or in combination); various fillers such as precipitated calcium carbonate, ground calcium carbonate, talc, clay, and kaolin; and various additives such as a sizing agent, a fixer, a retention aid, and a cationating agent as necessary.

In the present invention, the paper stuff may contain other additives, as appropriate, including a pigment dispersant, a thickener, a flow modifier, a defoamer, an antifoamer, a releasing agent, a foaming agent, a penetrant, a coloring dye, a coloring pigment, an optical brightener, an ultraviolet absorber, an antioxidant, a preservative, a fungicide, an insolubilizer, a wet paper strengthening agent, and a dry paper strengthening agent within the range that does not impair the desired effects of the present invention.

In the present invention, the base paper may have any degree of sizing that does not impair the desired effects of the present invention. The degree of sizing of the base paper can be adjusted by the amount of the internal sizing agent and/or the coating weight of the surface sizing agent that is applied on the base paper. An example of the internal sizing agent for acid base paper is a rosin sizing agent, and examples of the internal sizing agent for acid-free base paper include alkenyl succinic anhydride, alkyl-ketene dimer, an acid-free rosin sizing agent, and a cationic styrene-acryl sizing agent. Examples of the surface sizing agent include a styrene-acryl sizing agent, an olefin sizing agent, and a stylene-malein sizing agent.

In the present invention, the ash content in the base paper is preferably from 10 mass % to 25 mass %, and more preferably from 15 mass % to 20 mass % to achieve ink absorption properties suitable for industrial inkjet printing machines.

The ash content as used herein refers to the ratio of the mass of incombustibles remaining in the base paper after the paper underwent a combustion treatment at 500° C. for 1 hour to the absolute dry mass of the base paper before the combustion treatment. The ash content may be adjusted by the content of the components such as fillers in the base paper.

In the present invention, although the thickness of the base paper is not particularly limited, the base paper preferably has a thickness of from 50 μm to 300 μm, and more preferably from 80 μm to 250 μm.

In the present invention, the base paper may be calendered before use.

In the present invention, the coated printing paper includes a coating layer composed of at least two layers, which is provided on at least one surface of the base paper. The coating layer composed of at least two layers includes a first coating layer and a second coating layer. The first coating layer is a coating layer provided on the base paper. The coating composition for the first coating layer is a coating color composition that is applied on the base paper and dried to form the first coating layer. In the present invention, the second coating layer is a coating layer provided on the first coating layer and is separated from the base layer by the first coating layer. The coating composition for the second coating layer is a coating color composition that is applied on the first coating layer and dried to form the second coating layer. These coating compositions are typically applied in the form of an aqueous liquid that contains components dissolved or dispersed in water. In the present invention, one or more coating layers may further be provided on the second coating layer such that the additional layers are separated from the first coating layer by the second layer. In view of the production cost, the coating layer preferably consists of two layers, a first coating layer and a second coating layer.

In the present invention, the first coating layer contains a dogtooth-shaped precipitated calcium carbonate as an inorganic pigment. The first coating layer may contain, in addition to a dogtooth-shaped precipitated calcium carbonate, other inorganic pigments to the extent not to impair the effects of the present invention. Examples of the inorganic pigments other than a dogtooth-shaped precipitated calcium carbonate include conventional inorganic pigments such as needle-like or cuboidal precipitated calcium carbonates, ground calcium carbonate, kaolin, silica, alumina, and hydrated alumina. The content of the dogtooth-shaped precipitated calcium carbonate in the first coating layer is preferably 85 mass parts or more with respect to 100 mass parts of the solid content of the total inorganic pigments in the first coating layer. The precipitated calcium carbonate is a chemically produced calcium carbonate.

Examples of the process for producing a precipitated calcium carbonate include a carbonation process or a soluble salt reaction process. The carbonation process is a process for producing a precipitated calcium carbonate by dissolving calcined lime, which is obtained by calcining lime stone, in water to have a lime milk, and reacting the lime milk with carbon dioxide. The soluble salt reaction process is a process for producing a precipitated calcium carbonate by reacting a calcium chloride solution and sodium carbonate with a lime milk. The crystalline form, size and shape of a precipitated calcium carbonate may be adjusted by, for example, the reaction conditions. The crystalline shape of the precipitated calcium carbonate includes calcite crystals and aragonite crystals. Calcite crystals typically have a dogtooth shape, or a chestnut burr-like shape as an aggregate and cohesion of dogtooth shaped crystals, or a cuboidal (cubic or ball-like) shape. Aragonite crystals typically have a rod-like or needle-like shape. With the first coating layer containing a dogtooth-shaped precipitated calcium carbonate, the coated printing paper of the present invention achieves offset printability; ink absorption properties suitable for industrial inkjet printing machines; desirable color densities of images when printed by an industrial inkjet printing machine that uses water-based dye inks; and elimination or reduction of uneven printing in images when printed by an industrial inkjet printing machine that uses water-based pigment inks. Although the reason or mechanism behind this is not clear, the shape of the calcium carbonate is believed to affect the particle arrangement when coating layers are formed, thereby achieving such effects.

In the present invention, the size of the dogtooth-shaped precipitated calcium carbonate is as follows: the minor axis is from 0.1 μm to 0.5 μm and the major axis is from 0.5 μm to 2.5 μm. "Dogtooth" refers to the shape of a cylindrical particle that is thicker in the middle section and tapers off at both ends. An example of dogtooth shape is a rugby ball like. Here, the major axis is the distance between the two ends where the cylindrical particle tapers off. The minor axis is the diameter of the circle when the perimeter of the cross section where the particle is thickest is seen as a circumference. Paper containing a dogtooth-shaped precipitated calcium carbonate having a minor axis and a major axis outside the above-described range of the present invention would exhibit reduced ink absorption properties or reduced color densities of water-based dye inks in printing by an industrial inkjet printing machine The shape and the minor axis and major axis of a dogtooth-shaped precipitated calcium carbonate can be determined by analyzing the image taken by a scanning electron microscope.

The dogtooth-shaped precipitated calcium carbonate preferably has a major axis of 2 μm or less and the rate of the major axis to the minor axis is from 2 to 10. This configuration helps the coated paper to have further superior absorption properties suitable for printing by an industrial inkjet printing machine, exhibit further superior water resistance of images when printed by an industrial inkjet printing machine that uses water-based dye inks, and further superior reduction or elimination of uneven printing in images when printed by an industrial inkjet printing machine that uses water-based dye inks.

In the present invention, the first coating layer contains a binder. The binder may be a water-dispersible or water-soluble binder, and known binders may be used. Examples of the water dispersible binder include but are not limited to conjugated diene copolymer latexes such as styrene-butadiene copolymer or acrylonitrile-butadiene copolymer; acrylic copolymer latexes such as polymer of acrylic acid ester or methacrylic acid ester or methyl methacrylate-butadiene copolymer; vinyl copolymer latexes such as ethylene-vinyl acetate copolymer and vinyl chloride-vinyl acetate copolymer; urethane resin latexes; alkyd resin latexes; unsaturated polyester resin latexes; and functional group-modified copolymer latexes of these copolymers modified by their functional group-containing monomers (e.g., carboxyl group); and thermosetting synthetic resins such as melamine resins and urea resins. Examples of the water-soluble binder include but are not limited to starch derivatives such as oxidized starch, etherified starch, and phosphate starch; cellulose derivatives such as methylcellulose, carboxymethylcellulose, and hydroxyethyl cellulose; polyvinyl alcohol derivatives such as polyvinyl alcohol or silanol modified polyvinyl alcohol; natural polymeric resins such as casein, and gelatin or their modified products, soybean protein, pullulan, gum arabic, karaya gum, and albumin or their derivatives; vinyl polymers such as sodium polyacrylate, polyacrylamide, and polyvinylpyrrolidone; sodium alginate; polypropylene glycol; polyethyleneglycol; maleic anhydride or their copolymers. The binder is preferably an ethylene-vinyl acetate copolymer or a polyvinyl alcohol.

In the present invention, the content of the binder in the first coating layer is preferably from 20 mass parts to 40 mass parts, and more preferably from 25 mass to 35 mass parts with respect to 100 mass parts of the total solid content of the inorganic pigment contained in the first coating layer. The coated printing paper that contains the binder in the first coating layer within the above-described range will exhibit further superior ink absorption properties in printing by an industrial inkjet printing machine.

In the present invention, the first coating layer contains a cationic compound. The cationic compound is a cationic resin or a polyvalent cation salt. The cationic resin is a cationic polymer or a cationic oligomer, and conventional ones may be used. Preferable cationic resins are polymers or oligomers that contain a primary to tertiary amine or a quaternary ammonium salt in which protons easily coordinate and which exhibit a cationic property as a result of dissociation when dissolved in water. Specific examples of the cationic resin include but are not limited to compounds such as polyethylenimine, polyvinylpyridine, polyamine sulfone, polydialkylaminoethylmethacrylate, polydialkylaminoethylacrylate, polydialkylaminoethylmethacrylamide, polydialkylaminoethylacrylamide, polyepoxyamine, polyamideamine, dicyandiamide-formalin polycondensates, dicyandiamidepolyalkyl-polyalkylenepolyamine polycondensate, polyvinylamine, polyallylamine and hydrochlorides thereof; diallylamine-acrylamide copolymers; copolymers of polydiallyldimethylammonium chloride and diallyldimethylammonium chloride with, for example, acrylamide; polydiallylmethylamine hydrochloride; dimethylamine-ammonia-epichlorohydrin polycondensates; and polycondensates of aliphatic monoamine or aliphatic polyamine with an epihalohydrin compound. In the present invention, although the average molecular weight of the cationic resin is not particularly limited, it is preferably from 500 to 20,000, and more preferably from 1,000 to 10,000.

The cationic resin is preferably a polycondensate of an aliphatic monoamine or aliphatic polyamine with an epihalohydrin compound to achieve desirable water resistance of printed images when printed by an industrial inkjet printing machine that uses water-based dye inks.

The polycondensate of an aliphatic monoamine or aliphatic polyamine with an epihalohydrin compound is a polycondensate between one or more compounds selected from aliphatic monoamines and aliphatic polyaminse and one or more compounds selected from epihalohydrin compounds. Examples of the aliphatic monoamine include monomethylamine, monoethylamine, dimethylamine, diethylamine, trimethylamine, triethylamine, and mono-, di- or tri-ethanolamine. Examples of the aliphatic polyamine include ethylenediamine, diethylenetriamine, triethylenetetramine, pentaethylenehexamine, meta-xylenediamine, hexamethylenediamine, dimethylaminoethylamine, dimethylaminopropylamine, and 1,3-diaminobutane. Examples of the epihalohydrin compound include epichlorohydrin, epibromohydrin, methylepichlorohydrin, and methylepibromohydrin. Examples of the polycondensate of an aliphatic monoamine or an aliphatic polyamine with an epihalohydrin compound include dimethylamine-epichlorohydrin polycondensates and diethylene triamine-epichlorohydrin polycondensates. Dimethylamine-epichlorohydrinpoly condensates are preferable for easy commercial availability.

In the present invention, the polyvalent cation salt is a water-soluble salt that contains a metal multivalent cation. The polyvalent cation salt is preferably a salt that contains a metal multivalent cation and is soluble in an amount of 1 mass % or more in water at 20° C. Examples of the metal multivalent cation include divalent cations such as magnesium, calcium, strontium, barium, nickel, zinc, copper, iron, cobalt, tin, and manganese; tervalent cations such as aluminum, iron, and chrome; or tetravalent cations such as titanium and zirconium; and complex ions thereof. The anion that forms a salt with a metal multivalent cation may be either an inorganic acid or an organic acid, and is not particularly limited. Examples of the inorganic acid include hydrochloric acid, nitric acid, phosphoric acid, sulfuric acid, boric acid, and hydrofluoric acid. Examples of the organic acid include formic acid, acetic acid, lactic acid, citric acid, oxalic acid, succinic acid, and organic sulfonic acid. The polyvalent cation salt is preferably a calcium salt, and more preferably calcium chloride, because this selection further eliminates or reduces uneven printing in printed images when printed by an industrial inkjet printing machine that uses water-based pigment inks.

In the present invention, the content of the cationic compound in the first coating layer is preferably from 3 mass parts to 20 mass parts, and more preferably from 5 mass parts to 15 mass parts with respect to 100 mass parts of the total solid inorganic pigment contained in the first coating layer. A coated paper including the first coating layer that contains the cationic compound in an amount within the above-described range achieves superior color densities and water resistance of printed images when printed by an industrial inkjet printing machine with water-based dye inks, and also less uneven printing in printed images when printed by an industrial inkjet printing machine with water-based pigment inks. In the present invention, the first coating layer preferably contains at least a cationic resin and calcium chloride as the cationic compound, because use of a cationic resin in combination with calcium chloride further improves water resistance of printed images when printed by an industrial inkjet printing machine with water-based dye inks, and reduces or eliminates uneven printing in the images when printed by an industrial inkjet printing machine with water-based pigment inks.

In the present invention, the first coating layer contains an organic pigment. Examples of the organic pigment include pigments made of a thermoplastic resin such as styrene resin, styrene-acryl resin, acryl resin, ethylene resin, vinyl acetate copolymer olefin resin, propylene resin, acetal resin, chlorine ether resin, and vinyl chloride resin. The organic pigment may be an organic pigment in which these resins each form a multi-layered structure. The organic pigment is preferably styrene resin, acryl resin or styrene-acryl resin to achieve desirable ink absorption properties and gloss of the top layer in printing by an industrial inkjet printing machine.

In the present invention, the organic pigment preferably has a mean particle size of from 0.3 μm to 3 μm, and more preferably from 0.5 μm to 1 μm. With the organic pigment in the first coating layer having a mean particle size within the above-described range, the ink absorption properties of the paper when printed by an industrial inkjet printing machine are more desirable. The mean particle size of an organic pigment can be determined by electron microscopy. Specifically, the dispersed particles are observed using electron microscopy and 100 particles are selected within a given area. The diameter of the circle corresponding to the projected area of each particle is taken as the size of the particle, and these particle sizes are then averaged to give the mean particle size.

In the present invention, the organic pigment may have any shape selected from, for example, solid spherical, hollow spherical, bowl-like, erythrocyte-like, and Konpeito-like shapes. Two or more shapes may be suitably selected and used in combination. A preferred shape of the organic pigment is a hollow spherical or bowl-like shape. A hollow spherical organic pigment consists of particles each having one or more voids (hollows) in the inside. A bowl-shaped organic pigment is a kind of shape that may be obtained by cutting off a part of a hollow spherical organic pigment. The organic pigment is more preferably a hollow spherical organic pigment. These shapes are preferable because they provide the coated printing paper with desirable gloss and desirable ink absorption properties in printing by an industrial inkjet printing machine. The hollow spherical organic pigment preferably has a mean porosity of 20 volume % or more. "Porosity" refers to the proportion of voids with respect to the volume of the organic pigment.

Such solid spherical organic pigments, hollow spherical organic pigments and bowl-shaped organic pigments are commercially available, and such commercially available products may be used for the present invention. Examples of solid spherical organic pigments include L8801 (by Asahi Kasei Corporation) and Are-Pearl F-4P (by Negami Chemical Industrial Co., Ltd). Examples of the hollow spherical organic pigment include ROPAQUE HP-1055, HP-91, OP-84J, and HP-433J (all by Rohm and Haas). An example of a bowl-shaped organic pigment is V2005 (by Zeon Corporation).

In the present invention, the content of the organic pigment in the first coating layer is preferably from 5 mass parts to 20 mass parts, and more preferably from 8 mass parts to 15 mass parts with respect to the total solid content of 100 mass parts of the inorganic pigment in the first coating layer. The coated printing paper that contains the organic pigment within the above-described range in the first coating layer achieves desirable ink absorption properties in printing by an industrial inkjet printing machine.

In the present invention, the method of providing the first coating layer is not particularly limited, and one method is to apply the coating composition for the first coating layer on the base paper using a conventional coating device and dry the coating composition. Examples of the coating device include but are not limited to various blade coaters (such as rod blade coaters), air knife coaters, roll coaters, bar coaters, curtain coaters, and short dwell coaters. The coating device is preferably a blade coater, a curtain coater or a film transfer coater, which is suitable for high speed production, and, more preferably, a curtain coater.

In the present invention, the coating weight of the first coating layer is preferably from 5.0 g/m$^2$ to 12.0 g/m$^2$ per surface. Within this range, the coated printing paper achieves more desirable offset printability and ink absorption properties in printing by an industrial inkjet printing machine. In the present invention, the coating weight of the first coating layer indicates the coating weight of the dry solid content.

In the present invention, the first coating layer may contain additives such as a pigment dispersant, a thickener, a flow modifier, a viscosity stabilizer, a pH adjuster, a surfactant, a defoamer, an antifoamer, a releasing agent, a foaming agent, a penetrant, a coloring dye, a coloring pigment, a white inorganic pigment, a white organic pigment, an optical brightener, an ultraviolet absorber, an antioxidant, a leveling agent, a preservative, a fungicide, an insolubilizer, a wet paper strengthening agent, and a dry paper strengthening agent as appropriate within the range not to impair the purpose of the present invention.

In the present invention, the surface of the first coating layer may be smoothened, as appropriate, by calendering treatment using, for example, a machine calender, a soft nip calender, a super calender, a multistage calender, and a multinip calender. The first coating layer needs not undergo calendaring treatment.

The coated paper of the present invention for printing by an industrial inkjet printing machine includes a second coating layer. The second coating layer contains, as a pigment, at least an inorganic fine particle selected from hydrated alumina, gas phase process silica, pulverized wet-process silica and colloidal silica. As used herein, "inorganic ultrafine particle" indicates an inorganic fine particle that has a mean particle size of 330 nm or less. As used herein, "mean particle size" may refer to a mean primary particle size or may refer to a mean secondary particle size. In other words, in the case of the inorganic ultrafine particles in which primary particles aggregate to form secondary particles, "the mean particle size is 330 nm or less" indicates that the mean secondary particle size is 330 nm or less. In the case of the inorganic ultrafine particles which do not form secondary particles, "the mean particle size is 330 nm or less" indicates that the primary particle size is 330 nm or less. The inorganic ultrafine particles according to the present invention may be conventional inorganic ultrafine particles, for example, pseudo-boehmite sol (which is a hydrated alumina), colloidal silica, silica sol like the one obtained by dispersing a gas phase process silica with a high speed homogenizer, and mechanically pulverized wet process silica. Examples of the pseudo-boehmite sol, which is a hydrated alumina are described, for example, in Japanese Patent Application Kokai Publication Nos. H1-97678, H3-281383, H3-285814, H3-285815, H4-267180, and H4-275917. Examples of the colloidal silica are described, for example, in Japanese Patent Application Kokai Publication Nos. S60-219083, S61-19389, S61-188183, S63-178074, and H5-51470. Examples of the silica sol like the one obtained by dispersing a gas phase process silica at a high speed homogenizer are described, for example, in Japanese Patent Application Kokai Publication Nos. H10-119423 and H10-217601. Examples of the mechanically pulverized wet process silica are described, for example, in Japanese Patent Application Kokai Publication Nos. H10-181191, H10-272833, 2001-199158, and 2002-331747. The inorganic ultrafine particles preferably contain at least one of hydrated alumina and colloidal silica. This gives more desirable gloss to the coated printing paper.

The mean primary particle size of the ultrafine inorganic particles can be determined by electron microscopy. Specifically, the dispersed fine particles are observed using electron microscopy and 100 particles are selected within a given area. The diameter of the circle corresponding to the projected area of each particle is taken as the size of the primary particle, and these particle sizes are then averaged to give the mean primary particle size. The mean secondary particle size of the inorganic fine particles may be determined by measuring a dilute dispersion of the fine particles on a volumetric basis using a particle size analyzer that employs a laser diffractometry scattering method.

Commercially available products may be used as the inorganic fine particle according to the present invention. The hydrated alumina according to the present invention is commercially available under the trade names of, for example, Cataloid AS-1, Cataloid AS-2, and Cataloid AS-3 (by Catalysts & Chemicals Ind. Co., Ltd.); Alumina Sol 100, Alumina Sol 200, and Alumina Sol 520 (by Nissan Chemical Industries, Ltd.); M-200 (by Mizusawa Industrial Chemicals, Ltd.), Alumi Sol 10, Alumi Sol 20, Alumi Sol 132, Alumi Sol 132S, Alumi Sol SH5, Alumi Sol CSA55, Alumi Sol SV102, and Alumi Sol SB52 (by Kawaken Fine Chemicals Co., Ltd.); and DISPERAL HP-14, DISPERAL HP-18, and DISPERAL HP-60 (by Sasol). The gas phase process silica according to the present invention is available under the trade name of, for example, Aerosil (by Nippon Aerosil Co., Ltd.). The pulverized wet-process silica according to the present invention is available under the trade name of, for example, Sylojet 733C, Sylojet 710A, Sylojet A25, and Sylojet C30 (by Grace Davison). The colloidal silica according to the present invention is available under the trade name of, for example, Ludox CL and Ludox CL-P (by Grace Davison); and ST-AK, ST-AK-L, and MP-4540 (by Nissan Chemical Industries, Ltd.).

In the present invention, the second coating layer preferably contains a binder. Like the binder of the first coating layer, the binder of the second coating layer may be one or more selected as appropriate from conventional water-dispersible or water-soluble binders. The binder contained in the second coating layer is preferably polyvinyl alcohol to achieve offset printability.

In the present invention, the content of the binder in the second coating layer is preferably from 5 mass parts to 20 mass parts, and more preferably from 8 mass parts to 15 mass parts with respect to 100 mass parts of the solid content of the inorganic fine particles contained in the second coating layer. This is because when the binder is contained in the second coating layer within the above-described range, more desirable ink absorption properties of the paper can be achieved in printing by an industrial inkjet printing machine.

In the present invention, the second coating layer may contain, as appropriate, various additives such as a dye fixer, a thermoplastic resin, a surfactant, a defoamer, a thickener, a color adjusting agent, an optical brightener, an antioxidant, and an ultraviolet absorber.

The method of providing the second coating layer is not particularly limited, and one method is to apply the coating composition for the second coating layer on the first coating layer and dry the coating composition with a conventional coating device. Examples of the coating device include but are not limited to various blade coaters (such as rod blade coaters), air knife coaters, roll coaters, bar coaters, curtain coaters, and short dwell coaters. The coating device is preferably a blade coater, a curtain coater or a film transfer coater, which is suitable for high speed production, and, more preferably, a curtain coater.

In the second aspect of the present invention, the pH of the coating composition for the second coating layer is from 5.0 to 6.5. The pH of the coating composition for the second coating layer is preferably from 5.1 to 6.3, and more preferably from 5.2 to 6.0. With the coating composition for the second coating layer having a pH within this range, the coated printing paper achieves more desirable color densities and water resistance when printed by an industrial inkjet printing machine that uses water-based dye inks.

The pH of the coating composition for forming the second coating layer may be adjusted by adding an acid or an alkali to the coating color composition for the second coating layer. Examples of the acid include inorganic acids such as hydrochloric acid, nitric acid, sulfuric acid, and phosphoric acid; and organic acids such as acetic acid, citric acid, and succinic acid. Examples of the alkali include such as sodium hydroxide, ammonium water, an alkali metal salt of weak acid such as potassium carbonate, tertiary sodium phosphate, and sodium acetate.

In the first aspect of the present invention, the second coating layer has a surface pH of from 5.0 to 7.5. The pH is measured in the following procedure in accordance with JAPAN TAPPI No. 49-2: 2000. An indicator solution for determining a pH is dropped on the surface of the second coating layer, and is spread into a thin layer with an absorbent cotton or the like to color the solution. When the indicator solution for determining a pH is half-dried and the color of the indicator is stable, the hue of the indicator is observed. By comparing the hue that the indicator shows with the hues in the pH standard color change table, the pH on the paper surface side of the second coating layer is determined. When the paper surface-side pH of the second coating layer is within the above-described range, the coated printing paper exhibits more desirable color densities and water resistance of printed images when printed by an industrial inkjet printing machine that uses water-based dye inks.

The paper surface-side pH of the second coating layer may be adjusted by adding an acid or an alkali to the coating color composition for forming the second coating layer. The paper surface-side pH of the second coating layer may also be controlled by applying an acid aqueous solution or an alkali aqueous solution onto the second coating layer after the second coating layer is formed. For the acid or alkali, the same acid or alkali for adjusting the pH of the coating composition as the second coating layer, which is described in the second aspect of the present invention, may be used.

In the coated printing paper of the present invention, it would suffice if either the pH of the coating composition for the second coating layer or the paper surface-side pH of the second coating layer is satisfied, but both may be satisfied.

In the present invention, the coating weight of the second coating layer is preferably from 4.0 g/m$^2$ to 12.0 g/m$^2$ per surface. Within this range, the coated printing paper achieves more desirable offset printability, and ink absorption properties for printing by an industrial inkjet printing machine. In the present invention, the coating weight of the second coating layer indicates the coating weight of the dry solid content.

In the present invention, the surface of the second coating layer has a 75-degree gloss value as defined by JIS Z8741 of 45% or more. The 75-degree gloss value is preferably from 50% to 80%, and particularly preferably from 60% to 80%. The coated printing paper that has a 75-degree gloss value within this range has a more desirable gloss.

The gloss value of the surface of the second coating layer can be controlled by the type and the mean particle size of the inorganic ultrafine particles contained in the second coating layer. The gloss value of the second coating layer can also be controlled by incorporating a conventional matting agent into the second coating layer. The gloss value of the second coating layer can be enhanced by calendering treatment using, for example, a machine calender, a soft nip calender, a super calender, a multistage calender, or a multi-nip calender. However, excessive calendering treatment may crush the voids in the second coating layer and the first coating layer, and then reduce the ink absorption properties of the coated paper in printing by an industrial inkjet printing machine. Thus, it is preferred that calendering treatment be performed moderately.

In the present invention, the first coating layer and the second coating layer may be provided on both surfaces of the base paper. Providing these layers on both surfaces is preferable, because this allows double-face printing depending on the printing machine.

The resultant coated printing paper is processed into sheets of various sizes or rolls according to use as a final product. For storage, the products are preferably moisture-proof packaged to prevent the products from absorbing moisture. Although the grammage of the coated printing paper is not particularly limited, it is preferred that the grammage of the paper be from 40 g/m$^2$ to 250 g/m$^2$ in the field of commercial printing such as printing of invoices, account statements, ad-papers and direct mails, as well as combinations thereof, namely, so-called transaction promotion.

The coated printing paper according to the present invention can be used for offset printing and/or inkjet printing, and creates printed images with superior image quality and durability. The coated printing paper of the present invention may advantageously be used in industrial inkjet printing machines, for example, in inkjet printing machines of a web press system having a printing speed of 60 m/min or more, and a still higher speed exceeding 120 m/min, to create printed images with superior image quality and durability. The coated printing paper of the present invention can also be used not only for offset printing, but also for other types of printing such as gravure printing and dry and wet-type electrophotographic printing. In addition to industrial inkjet printing machines, the coated printing paper can be used for printers such as commercially available inkjet printers for small offices home offices (SOHOs).

Yet a further aspect of the present invention is a printing method using an industrial inkjet printing machine. The method includes the steps of feeding the coated printing paper, and forming a printed image on the coated printing paper by an industrial inkjet printing machine using water-based dye inks or water-based pigment inks at a printing speed of 60 m/min or more. Thus, a printed image superior in color densities and water resistance with less uneven printing can be produced. Still another aspect of the present invention is a process for forming a printed image which includes the steps of feeding the coated printing paper, and forming a printed image on the coated printing paper by an offset printing machine and/or an industrial inkjet printing machine. Thus, a desirable printed image can be formed using an offset printing machine and/or an industrial inkjet printing machine.

EXAMPLES

The present invention will be described in more detail below by presenting Examples, but the present invention is not limited to the Examples given below unless the spirit of the present invention is not exceeded. In the Examples, "part(s)" and "%" refer to part(s) by mass and mass % of dry solid content or solid components, unless otherwise mentioned. "Coating weight" refers to the coating weight of dry solid content.

(Preparation of Base Paper)

The base paper was prepared as follows. To a pulp slurry that contains 100 parts of LBKP having a freeness of 400 mlcsf, 16 parts of ground calcium carbonate as fillers, 0.8 parts of amphoteric starch, 0.8 parts of aluminum sulfate, and 0.15 parts of an alkyl-ketene dimer sizing agent (Sizepine K903 by Arakawa Chemical Industries, Ltd.) were added. The pulp slurry was then made into paper using a Fourdrinier machine. Oxidized starch was applied to the both surfaces of the resultant paper by a size presser in an amount of 2.0 g/m$^2$ in total, and the paper was subjected to a machine calendering treatment to prepare a base paper having a grammage of 100 g/m$^2$.

<Preparation of the Coating Composition for the First Coating Layer>

The coating composition of the first coating layer was prepared according to the following formulation.

| | |
|---|---|
| Inorganic pigment | 100 parts |
| Polyvinyl alcohol | 15 parts |
| Ethylene-vinyl acetate copolymer | 10 parts |
| Cationic compound | see Table 1 for its part |
| Organic pigment | see Table 1 for its part |

After formulating the composition according to the above-described formulation, the composition was mixed with and dispersed into water, and the concentration of the solid content of the coating composition was adjusted to 40%.

<Preparation of the Coating Composition for the Second Coating Layer>

The coating composition of the second coating layer was prepared according to the following formulation.

| | |
|---|---|
| Inorganic ultrafine particle or inorganic particle | see Table 1 for its part |
| Polyvinyl alcohol | 15 parts |

After formulating the composition according to the above-described formulation, the composition was mixed with and dispersed into water, and the concentration of the solid content of the coating composition was adjusted to 20%.

(Adjustment and Measurement of pH)

The pH of the coating composition for the second coating layer was adjusted by the amount of acetic acid or sodium hydrate as appropriate. Table 1 shows the pH of the coating composition for the second coating layer.

The pH on the paper surface side of the second coating layer was measured in accordance with JAPAN TAPPI No. 49-2: 2000. Specifically, an indicator solution by Advantec Toyo Kaisha, Ltd. for determining a pH was dropped on the surface of the second coating layer, and was spread into a thin layer with an absorbent cotton or the like to color the solution. When the indicator solution for determining a pH was half-dried and the color of the indicator was stable, the hue of the indicator was observed. By comparing the hue that the indicator showed with the hues in the pH standard color change table, the surface pH of the second coating layer was determined. Table 1 shows the surface pH of the second coating layer. According to the range of the pH to be measured, different pH measurement indicators can be used. For the range of pH from 3.6 and 5.8, a bromocresol green solution was used as an indicator solution for determining a pH, and for the range of pH from 5.8 to 8.2, a bromothymol blue solution was used as an indicator solution for determining a pH.

TABLE 1

| | Coating composition for First coating layer | | | Coating composition for Second coating layer | | | | | | | | Surface pH |
|---|---|---|---|---|---|---|---|---|---|---|---|---|
| | Inorganic pigment Type | Cationic compound Type/parts | Organic pigment Type/parts | Inorganic ultrafine particle or Inorganic particle N parts | O parts | P parts | Q parts | R parts | S parts | T parts | pH of Coating Composition | of Second coating layer |
| Example 1 | A | U/15 | X/10 | 100 | | | | | | | 5.5 | 6.0 |
| Example 2 | A | U/15 | X/10 | | 100 | | | | | | 5.5 | 5.9 |
| Example 3 | A | U/15 | X/10 | | | 100 | | | | | 5.5 | 5.9 |
| Example 4 | A | U/15 | X/10 | | | | 100 | | | | 5.5 | 5.9 |
| Example 5 | A | U/15 | X/10 | 80 | | | 20 | | | | 5.5 | 6.0 |
| Example 6 | A | Z/15 | X/10 | 80 | | | 20 | | | | 5.5 | 5.9 |
| Example 7 | A | U/15 | X/10 | 60 | | | 40 | | | | 5.5 | 6.0 |
| Example 8 | A | Z/15 | X/10 | 60 | | | 40 | | | | 5.5 | 5.9 |
| Example 9 | A | U/15 | X/10 | 40 | | | 60 | | | | 5.5 | 5.9 |
| Example 10 | A | Z/15 | X/10 | 40 | | | 60 | | | | 5.5 | 5.8 |
| Example 11 | A | U/15 | X/10 | | 60 | | 40 | | | | 5.5 | 5.9 |
| Example 12 | A | U/15 | X/10 | | | 60 | 40 | | | | 5.5 | 5.9 |
| Example 13 | A | U/15 | X/10 | 50 | | 30 | 20 | | | | 5.5 | 6.0 |
| Example 14 | A | U/15 | X/10 | 50 | 30 | | 20 | | | | 5.5 | 6.0 |
| Example 15 | B | U/15 | X/10 | 80 | | | 20 | | | | 5.5 | 6.0 |
| Example 16 | C | U/15 | X/10 | 80 | | | 20 | | | | 5.5 | 6.0 |
| Example 17 | D | U/15 | X/10 | 80 | | | 20 | | | | 5.5 | 6.0 |
| Example 18 | E | U/15 | X/10 | 80 | | | 20 | | | | 5.5 | 6.0 |
| Example 19 | A | U/2 | X/10 | 80 | | | 20 | | | | 5.5 | 6.5 |
| Example 20 | A | U/4 | X/10 | 80 | | | 20 | | | | 5.5 | 6.4 |
| Example 21 | A | U/19 | X/10 | 80 | | | 20 | | | | 5.5 | 5.9 |
| Example 22 | A | U/21 | X/10 | 80 | | | 20 | | | | 5.5 | 5.8 |
| Example 23 | A | V/15 | X/10 | 80 | | | 20 | | | | 5.5 | 6.0 |
| Example 24 | A | W/15 | X/10 | 80 | | | 20 | | | | 5.5 | 6.1 |
| Example 25 | A | U/10, W/10 | X/10 | 80 | | | 20 | | | | 5.5 | 6.1 |

TABLE 1-continued

| | Coating composition for First coating layer | | | Coating composition for Second coating layer | | | | | | | | Surface pH |
|---|---|---|---|---|---|---|---|---|---|---|---|---|
| | Inorganic | Cationic | Organic | Inorganic ultrafine particle or Inorganic particle | | | | | | | pH of | of Second |
| | pigment Type | compound Type/parts | pigment Type/parts | N parts | O parts | P parts | Q parts | R parts | S parts | T parts | Coating Composition | coating layer |
| Example 26 | A | Z/10, W/10 | X/10 | 80 | | | 20 | | | | 5.5 | 6.0 |
| Example 27 | A | U/15 | X/4 | 80 | | | 20 | | | | 5.5 | 5.9 |
| Example 28 | A | U/15 | X/6 | 80 | | | 20 | | | | 5.5 | 5.9 |
| Example 29 | A | U/15 | X/19 | 80 | | | 20 | | | | 5.5 | 6.1 |
| Example 30 | A | U/15 | X/21 | 80 | | | 20 | | | | 5.5 | 6.1 |
| Example 31 | A | U/15 | Y/10 | 80 | | | 20 | | | | 5.5 | 6.0 |
| Example 32 | A | U/15 | X/10 | 80 | | | 20 | | | | 5.1 | 5.2 |
| Example 33 | A | U/15 | X/10 | 80 | | | 20 | | | | 6.3 | 7.0 |
| Example 34 | A | U/15 | X/10 | 80 | | | 20 | | | | 6.5 | 7.3 |
| Comparative Example 1 | F | U/15 | X/10 | 80 | | | 20 | | | | 5.5 | 6.0 |
| Comparative Example 2 | G | U/15 | X/10 | 80 | | | 20 | | | | 5.5 | 6.0 |
| Comparative Example 3 | H | U/15 | X/10 | 80 | | | 20 | | | | 5.5 | 6.0 |
| Comparative Example 4 | I | U/15 | X/10 | 80 | | | 20 | | | | 5.5 | 6.0 |
| Comparative Example 5 | J | U/15 | X/10 | 80 | | | 20 | | | | 5.5 | 6.0 |
| Comparative Example 6 | K | U/15 | X/10 | 80 | | | 20 | | | | 5.5 | 6.0 |
| Comparative Example 7 | L | U/15 | X/10 | 80 | | | 20 | | | | 5.5 | 6.1 |
| Comparative Example 8 | M | U/15 | X/10 | 80 | | | 20 | | | | 5.5 | 6.0 |
| Comparative Example 9 | A | — | X/10 | 80 | | | 20 | | | | 5.5 | 6.7 |
| Comparative Example 10 | A | U/15 | — | 80 | | | 20 | | | | 5.5 | 5.9 |
| Comparative Example 11 | A | U/15 | X/10 | 80 | | | 20 | | | | 4.8 | 4.9 |
| Comparative Example 12 | A | U/15 | X/10 | 80 | | | 20 | | | | 6.7 | 7.7 |
| Comparative Example 13 | A | U/15 | X/10 | | | | | 100 | | | 6.5 | 7.9 |
| Comparative Example 14 | A | U/15 | X/10 | | | | | | 100 | | 5.5 | 6.0 |
| Comparative Example 15 | A | U/15 | X/10 | | | | | | | 100 | 5.5 | 6.2 |

The inorganic pigments, the inorganic ultrafine particles, the inorganic particles, the cationic compounds and the organic pigments indicated with abbreviations in Table 1 are specifically as follows.

(Inorganic Pigments)

A: precipitated calcium carbonate (dogtooth-shaped, minor axis: 0.3 μm, major axis: 1.7 μm)

B: precipitated calcium carbonate (dogtooth-shaped, minor axis: 0.15 μm, major axis: 0.6 μm)

C: precipitated calcium carbonate (dogtooth-shaped, minor axis: 0.15 μm, major axis: 2.3 μm)

D: precipitated calcium carbonate (dogtooth-shaped, minor axis: 0.4 μm, major axis: 0.6 μm)

E: precipitated calcium carbonate (dogtooth-shaped, minor axis: 0.4 μm, major axis: 2.3 μm)

F: precipitated calcium carbonate (dogtooth-shaped, minor axis: 0.07 μm, major axis: 0.4 μm)

G: precipitated calcium carbonate (dogtooth-shaped, minor axis: 0.07 μm, major axis: 2.7 μm)

H: precipitated calcium carbonate (dogtooth-shaped, minor axis: 0.6 μm, major axis: 2.7 μm)

I: precipitated calcium carbonate (needle-like, mean primary particle size: 0.4 μm)

J: precipitated calcium carbonate (cuboidal-shaped, mean primary particle size: 0.15 μm)

K: ground calcium carbonate

L: kaolin

M: synthetic amorphous silica (P705 by Tosoh Silica Corporation)

(Inorganic Fine Particles or Inorganic Particles)

N: hydrated alumina (mean secondary particle size: 0.16 μm, DISPERAL HP-14 by Sasol)

O: gas phase process silica (mean secondary particle size: 0.1 μm, Aerosil 200 by Nippon Aerosil Co., Ltd.)

P: pulverized wet-process silica (mean secondary particle size: 0.3 μm, Sylojet 733C by Grace Davison)

Q: colloidal silica (mean primary particle size: 0.022 μm, Ludox CL-P, by Grace Davison)

R: precipitated calcium carbonate (needle-shaped, mean primary particle size: 0.4 μm)

S: hydrated alumina (mean secondary particle size: 0.35 μm, DISPERAL HP-60, by Sasol)

T: colloidal silica (mean primary particle size: 0.45 μm, MP-4540 by Nissan Chemical Industries, Ltd.)

(Cationic Compound)

U: dimethylamine-epichlorohydrin polycondensate (JET FIX 5052 by Satoda Chemical Industrial Co., Ltd.)

V: diallylamine-acrylamide copolymer (SR1001 by Sumitomo Chemical Co., Ltd.)

W: calcium chloride

Z: polydiallyldimethylammonium chloride (PAS-H-1L by Nittobo Medical Co., Ltd.)

(Organic pigment)

X: a hollow spherical organic pigment (ROPAQUE HP-91 by Rohm and Haas)

Y: a bowl-shaped organic pigment (V2005 by Zeon Corporation)

The coated printing papers of Examples and Comparative Examples were prepared according to the following procedure.

<Preparation of Coated Printing Paper>

The coating composition for the first coating layer was applied to both surfaces of a base paper using a curtain coater in an amount of 8 g/m$^2$ per surface, and dried. After the first coating layers were dried, the coating composition for the second coating layer was applied on the first coating layers using a curtain coater in an amount of 7 g/m$^2$ per surface, and dried. After the second coating layers were dried, calendering treatment was carried out to prepare the coated printing paper. The calendering treatment was carried out using a device that includes an elastic roll and a metal roll at a linear nip pressure of 100 kN/m within the range in which an appropriate thickness profile can be obtained along the width. The temperature of the metal roll was set to 80° C.

Coated printing papers of Examples and Comparative Examples that were obtained in the above-described procedure were each evaluated for the following evaluation items according to the methods described below. Table 2 shows the results.

<Evaluation of Gloss Value>

The gloss value was measured at angles of incidence and reflection of 75 degrees using a digital gloss meter GM-26D by Murakami Color Research Laboratory Co., Ltd. It should be understood that in the present invention, if coated printing paper "has a gloss," it means that the gloss value is 45% or more.

<Offset Printability>

Printing was done on 6000 m of each sample using an web offset press by Miyakoshi Printing Machinery, Co., Ltd. under the following conditions: printing speed: 150 m/min; ink used: T&K TOKA UV BEST CURE black and bronze red; and UV irradiation dose: 8 kW two-lamp-type. After printing, the occurrence of blanket piling and the state (quality) of printing samples were visually evaluated on the following five-point scale. It should be understood that in the present invention, if coated printing paper "has desirable offset printability," it means that its evaluation score is either 3, 4 or 5 based on the following scale.

5: Excellent
4: Good
3: Practically usable
2: Poor
1: Extremely poor

<Ink Absorption Properties (Water-Based Dye Ink)>

Evaluation images were printed at 150 m/min by an industrial inkjet printing machine, New MJP-600 (Model: MJP-20C) manufactured by Miyakoshi Printing Machinery, Co., Ltd. using water-based dye inks. The evaluation printing was done by creating a row of adjacent 2 cm×2 cm blocks of solid colors perpendicular to the lengthwise axis of the sheet as the evaluation sample. The colors consist of a total of seven colors: primary colors (black, cyan, magenta and yellow) and secondary colors (red, green and blue) made from the 2 colors among the above 3-color inks, excluding the black ink. Bleeding across the boundaries of different color blocks was visually evaluated on the following five-point scale. It should be understood that in the present invention, if coated printing paper "has/exhibits desirable ink absorption properties (of water-based dye inks) in printing by an industrial inkjet printing machine," it means that its evaluation score is either 3, 4 or 5 based on the following scale.

5: No bleeding across the color boundaries.
4: Negligible bleeding across the color boundaries.
3: Bleeding can be observed across the color boundaries but the boundaries are clearly distinguishable.
2: The color boundaries are not clear and neighboring colors have run slightly across the boundaries.
1: The boundaries of separate colors are not distinguishable and there is significant bleeding into neighboring colors.

<Color Densities (Water-Based Dye Ink)>

Evaluation images were printed at 150 m/min by an industrial inkjet printing machine, New MJP-600 (Model: MJP-20C) manufactured by Miyakoshi Printing Machinery, Co., Ltd. using water-based dye inks. The evaluation printing was done by creating a row of adjacent 2 cm×2 cm blocks of solid colors perpendicular to the lengthwise axis of the sheet as the evaluation sample. The colors consist of a total of seven colors: primary colors (black, cyan, magenta and yellow) and secondary colors (red, green and blue) made from the 2 colors among the above 3-color inks, excluding the black ink. The color densities were visually evaluated in terms of color saturation and color lightness on the following five-point scale. It should be understood that in the present invention, if coated printing paper "has a desirable color densities for printing by an industrial inkjet printing machine," it means that its evaluation score is either 3, 4 or 5 based on the following scale.

5: Excellent in both color density and color vividness.
4: Good although either color density or color vividness is rated lower than "5".
3: Color density and color vividness are both at a practically usable level.
2: Either color density or color vividness is rated lower than "3" and practically unusable.
1: Poor in both color density and color vividness and practically unusable.

<Water Resistance of Printed Images (Water-Based Dye Ink)>

Evaluation images were printed at 150 m/min by an industrial inkjet printing machine New MJP-600 (Model: MJP-20C) manufactured by Miyakoshi Printing Machinery, Co., Ltd. using water-based dye inks. A halftone dot pattern that covers 50% of area and characters were printed using each of single colors, black, cyan, magenta, and yellow. After they were left for 24 hours, the printed portions were immersed in water for 30 seconds, and then excess water was wiped off with filter paper, and the printed portions were left to air dry. Bleeding was visually evaluated on the following five-point scale. It should be understood that in the present invention, if coated printing paper "has/exhibits desirable water resistance of printed images when printed by an industrial inkjet printing machine," it means that its evaluation score is either 3, 4 or 5 based on the following scale.

5: No bleeding.
4: Slight but negligible bleeding.
3: Slight bleeding can be observed but halftone dots and characters are clearly distinguishable.
2: Bleeding can be observed, and halftone dots and characters are blurred.
1: Bleeding is conspicuous and halftone dots and characters are very unclear.

<Ink Absorption Properties (Water-Based Pigment Ink)>

Evaluation images were printed at 75 m/min by industrial inkjet printing machine VERSAMARK VL2000 manufactured by Kodak Company using water-based pigment inks. The evaluation printing was done by creating a row of adjacent 2 cm×2 cm blocks of solid colors perpendicular to the lengthwise axis of the sheet as the evaluation sample. The colors consist of a total of seven colors: primary colors (black, cyan, magenta and yellow) and secondary colors (red, green and blue) made from the 2 colors among the above 3-color inks, excluding the black ink. Bleeding across boundaries of printed portions of different colors was visually evaluated on the following five-point scale. It should be understood that in the present invention, if coated printing paper "has desirable ink absorption properties (water-based pigment ink) in printing by an industrial inkjet printing machine," it means that its evaluation score is either 3, 4 or 5 based on the following scale.

5: No bleeding across color boundaries.
4: Negligible bleeding across color boundaries.
3: Bleeding can be observed across the color boundaries but the boundaries are clearly distinguishable.
2: The color boundaries are not clear and neighboring colors have run slightly across the boundaries.

1: The boundaries of separate colors are not distinguishable and there is significant bleeding into neighboring colors.

<Uneven Printing (Water-Based Pigment Ink)>

Evaluation images were printed at 75 m/min by an industrial inkjet printing machine, VERSAMARK VL2000 manufactured by Kodak Company using water-based pigment inks. The evaluation printing was done by creating a row of adjacent 3 cm×3 cm blocks of solid colors perpendicular to the lengthwise axis of the sheet as the evaluation sample. The colors consist of a total of seven colors: primary colors (black, cyan, magenta and yellow) and secondary colors (red, green and blue) made from the 2 colors among the above 3-color inks, excluding the black ink. Uneven printing of solid colors in printed portions was visually evaluated on the following five-point scale. It should be understood that in the present invention, if coated printing paper "has desirable property of reducing or eliminating uneven printing on printed images produced by an industrial inkjet printing machine," it means that its evaluation score is either 3, 4 or 5 based on the following scale.

5: No uneven printing is observed.

4: Uneven printing is slightly observed for some color(s).

3: Uneven printing is slightly observed.

2: Uneven printing is partially observed.

1: Uneven printing is observed on the entire printed portions.

TABLE 2

| | Evaluation results | | | | | | |
|---|---|---|---|---|---|---|---|
| | | | Inkjet printing machine Water-based dye ink | | | Inkjet printing machine Water-based pigment ink | |
| | Gloss 75-degree % | Offset printability | Ink absorption properties | color density | Water resistance of printed image | Ink absorption properties | Reduction or elimination of uneven printing |
| Example 1 | 64 | 4 | 5 | 4 | 5 | 5 | 4 |
| Example 2 | 52 | 3 | 5 | 4 | 4 | 5 | 4 |
| Example 3 | 51 | 3 | 4 | 4 | 4 | 4 | 4 |
| Example 4 | 66 | 5 | 4 | 4 | 5 | 5 | 4 |
| Example 5 | 65 | 5 | 5 | 4 | 5 | 5 | 5 |
| Example 6 | 64 | 5 | 5 | 4 | 4 | 5 | 5 |
| Example 7 | 66 | 5 | 4 | 4 | 5 | 5 | 4 |
| Example 8 | 65 | 5 | 4 | 4 | 4 | 5 | 4 |
| Example 9 | 67 | 5 | 4 | 4 | 5 | 5 | 4 |
| Example 10 | 66 | 5 | 4 | 4 | 4 | 5 | 4 |
| Example 11 | 57 | 4 | 5 | 4 | 4 | 5 | 4 |
| Example 12 | 56 | 4 | 4 | 4 | 4 | 4 | 4 |
| Example 13 | 59 | 4 | 4 | 4 | 5 | 4 | 4 |
| Example 14 | 60 | 4 | 5 | 4 | 5 | 5 | 4 |
| Example 15 | 68 | 5 | 5 | 4 | 5 | 5 | 5 |
| Example 16 | 63 | 5 | 4 | 4 | 4 | 4 | 4 |
| Example 17 | 66 | 5 | 5 | 4 | 4 | 4 | 4 |
| Example 18 | 62 | 5 | 4 | 4 | 4 | 4 | 4 |
| Example 19 | 60 | 5 | 4 | 3 | 3 | 4 | 3 |
| Example 20 | 62 | 5 | 4 | 4 | 4 | 4 | 4 |
| Example 21 | 66 | 4 | 4 | 4 | 4 | 4 | 4 |
| Example 22 | 66 | 4 | 4 | 3 | 4 | 4 | 3 |
| Example 23 | 63 | 4 | 5 | 4 | 4 | 5 | 4 |
| Example 24 | 62 | 4 | 5 | 5 | 3 | 5 | 4 |
| Example 25 | 64 | 4 | 5 | 5 | 5 | 5 | 5 |
| Example 26 | 63 | 4 | 5 | 5 | 4 | 5 | 5 |
| Example 27 | 55 | 4 | 3 | 4 | 5 | 3 | 4 |
| Example 28 | 59 | 4 | 4 | 4 | 5 | 4 | 4 |
| Example 29 | 71 | 4 | 4 | 4 | 4 | 4 | 4 |
| Example 30 | 73 | 3 | 3 | 4 | 4 | 3 | 4 |
| Example 31 | 65 | 4 | 4 | 4 | 5 | 4 | 4 |
| Example 32 | 63 | 4 | 5 | 4 | 5 | 5 | 4 |
| Example 33 | 66 | 4 | 5 | 4 | 5 | 5 | 4 |
| Example 34 | 66 | 4 | 5 | 4 | 5 | 5 | 4 |
| Comparative example 1 | 69 | 3 | 2 | 3 | 3 | 3 | 3 |
| Comparative example 2 | 62 | 3 | 2 | 2 | 3 | 2 | 3 |
| Comparative example 3 | 56 | 5 | 2 | 2 | 3 | 2 | 3 |
| Comparative example 4 | 60 | 4 | 2 | 2 | 3 | 2 | 3 |
| Comparative example 5 | 62 | 3 | 2 | 2 | 3 | 2 | 3 |
| Comparative example 6 | 50 | 3 | 2 | 2 | 3 | 3 | 3 |
| Comparative example 7 | 60 | 1 | 2 | 1 | 3 | 3 | 3 |
| Comparative example 8 | 39 | 3 | 5 | 2 | 3 | 5 | 5 |
| Comparative example 9 | 59 | 4 | 2 | 1 | 1 | 2 | 2 |
| Comparative example 10 | 42 | 3 | 2 | 3 | 3 | 2 | 3 |
| Comparative example 11 | 58 | 3 | 3 | 2 | 3 | 3 | 3 |
| Comparative example 12 | 62 | 3 | 3 | 2 | 2 | 3 | 2 |
| Comparative example 13 | 41 | 5 | 1 | 1 | 2 | 1 | 1 |
| Comparative example 14 | 56 | 2 | 2 | 3 | 3 | 2 | 2 |
| Comparative example 15 | 53 | 3 | 2 | 2 | 1 | 2 | 1 |

Table 2 shows that the coated printing papers according to the Examples, which belong to the present invention, have desirable offset printability and superior ink absorption properties in printing by an industrial inkjet printing machine; exhibit superior color densities and water resistance of printed images and superior reduction or elimination of uneven printing when printed by an industrial inkjet printing machine that uses water-based pigment inks; and desirable gloss.

Table 2 shows that Comparative Examples, which fail to satisfy the requirements of the present invention, cannot achieve the effects of the present invention.

The invention claimed is:

1. A coated paper for printing by an industrial inkjet printing machine, the coated paper comprising:

a base paper; and at least two coating layers, a first coating layer and a second coating layer, provided on at least one surface of the base paper, wherein the first coating layer is provided on the base paper and contains an organic pigment, a cationic compound, a binder, and a dogtooth-shaped precipitated calcium carbonate that has a minor axis of from 0.1 μm to 0.5 μm and a major axis of from 0.5 μm to 2.5 μm, the second coating layer is provided on the first coating layer and contains at least an inorganic ultrafine particle that is selected from hydrated alumina, gas phase process silica, pulverized wet-process silica, and colloidal silica, and that has a mean particle size of 330 nm or less, the coated paper has a surface pH of from 5.0 to 7.5, wherein the surface pH is determined in accordance with Japan Technical Association of the Pulp and Paper Industry (JAPAN TAPPI) No. 49-2: 2000 by dropping an indicator solution for determining a pH on a surface of the second coating layer, spreading the solution into a thin layer over the surface to color the solution, and comparing the hue that the indicator shows with the hues in a pH standard color change table, and the second coating layer has a 75-degree gloss value as defined by JIS Z8741 of 45% or more.

2. A coated paper for printing by an industrial inkjet printing machine, the coated paper comprising:

a base paper; and at least two coating layers, a first coating layer and a second coating layer, provided on at least one surface of the base paper, wherein the first coating layer is provided on the base paper and contains an organic pigment, a cationic compound, a binder, and a dogtooth-shaped precipitated calcium carbonate that has a minor axis of from 0.1 μm to 0.5 μm and a major axis of from 0.5 μm to 2.5 μm, the second coating layer is provided on the first coating layer and contains at least an inorganic ultrafine particle that is selected from hydrated alumina, gas phase process silica, pulverized wet-process silica, and colloidal silica, and that has a mean particle size of 330 nm or less, the second coating layer is formed by applying a coating composition on the first coating layer and drying the composition, the composition for forming the second coating layer having a pH exceeding 5.0 and 6.5 or less, and the second coating layer has a 75-degree gloss value as defined by JIS Z8741 of 45% or more.

3. The coated paper for printing by an industrial inkjet printing machine according to claim 1, wherein the organic pigment is a hollow spherical organic pigment.

4. The coated paper for printing by an industrial inkjet printing machine according to claim 1, which is used in printing by an industrial inkjet printing machine.

5. The coated paper for printing by an industrial inkjet printing machine according to claim 1, which is used in printing by an industrial inkjet printing machine and an offset printing machine.

6. The coated paper for printing by an industrial inkjet printing machine according to claim 2, wherein the organic pigment is a hollow spherical organic pigment.

7. The coated paper for printing by an industrial inkjet printing machine according to claim 2, which is used in printing by an industrial inkjet printing machine.

8. The coated paper for printing by an industrial inkjet printing machine according to claim 3, which is used in printing by an industrial inkjet printing machine.

9. The coated paper for printing by an industrial inkjet printing machine according to claim 2, which is used in printing by an industrial inkjet printing machine and an offset printing machine.

10. The coated paper for printing by an industrial inkjet printing machine according to claim 3, which is used in printing by an industrial inkjet printing machine and an offset printing machine.

* * * * *